US009637988B2

(12) United States Patent
Gordon

(10) Patent No.: US 9,637,988 B2
(45) Date of Patent: May 2, 2017

(54) FLUID VENT ASSEMBLY AND METHOD OF VENTING FLUID

(71) Applicant: RMSpumptools Limited, Oldmeldrum (GB)

(72) Inventor: Stuart David Gordon, Newmachar (GB)

(73) Assignee: RMSpumptools Limited, Oldmeldrum (GB)

( * ) Notice: Subject to any disclaimer, the term of this patent is extended or adjusted under 35 U.S.C. 154(b) by 212 days.

(21) Appl. No.: 14/390,602

(22) PCT Filed: Apr. 2, 2013

(86) PCT No.: PCT/GB2013/050853
§ 371 (c)(1),
(2) Date: Oct. 14, 2014

(87) PCT Pub. No.: WO2013/150283
PCT Pub. Date: Oct. 10, 2013

(65) Prior Publication Data

US 2015/0090462 A1 Apr. 2, 2015

(30) Foreign Application Priority Data

Apr. 5, 2012 (GB) ..... 1206157.8

(51) Int. Cl.
*E21B 34/00* (2006.01)
*E21B 29/08* (2006.01)
(Continued)

(52) U.S. Cl.
CPC ..... *E21B 29/08* (2013.01); *E21B 33/1204* (2013.01); *E21B 34/063* (2013.01);
(Continued)

(58) Field of Classification Search
CPC ..... E21B 29/08; E21B 34/06; E21B 34/063
See application file for complete search history.

(56) References Cited

U.S. PATENT DOCUMENTS 1,528,519 A * 3/1925 Wood ..... F04B 47/04
417/140
2,649,917 A * 8/1953 Simmons ..... E21B 27/00
166/102

(Continued)

OTHER PUBLICATIONS

Strømmen, Henrik, "International Search Report" prepared for PCT/GB2013/050853 as mailed Mar. 13, 2014, 4 pages.

*Primary Examiner* — John Kreck
(74) *Attorney, Agent, or Firm* — Winstead PC

(57) ABSTRACT

A housing for a downhole tool, having a fluid vent assembly comprising a port passing through the wall of the housing to transmit fluid through the port when the port is open, a sealing device to seal the port, and a cutting device to disrupt the sealing device and permit transmission of fluid through the port. The cutting device is driven axially through the sealing device without relative rotation between the two. The cutting device has an asymmetric blade to cut a coupon from the sealing device by a gradual and progressive disruption of the closure, typically cutting through only a portion the closure device, so that the coupon cut from the closure device remains attached to the closure device when the closure device is ruptured to open the seal. Typically the downhole tool comprises a downhole pump, and the housing comprises the shroud of the pump.

45 Claims, 8 Drawing Sheets

(51) Int. Cl.

| | |
|---|---|
| ***E21B 34/08*** | (2006.01) |
| ***E21B 34/06*** | (2006.01) |
| ***E21B 43/12*** | (2006.01) |
| ***E21B 33/12*** | (2006.01) |
| ***E21B 34/14*** | (2006.01) |

(52) U.S. Cl.
CPC ..... *E21B 34/08* (2013.01); *E21B 34/14* (2013.01); *E21B 43/128* (2013.01)

(56) References Cited

U.S. PATENT DOCUMENTS

| | | | | |
|---|---|---|---|---|
| 3,581,819 | A | 6/1971 | Tamplen | |
| 5,411,098 | A | 5/1995 | Schmidt et al. | |
| 5,479,986 | A * | 1/1996 | Gano | E21B 23/00 166/192 |
| RE39,209 | E * | 8/2006 | Barton | E21B 33/1295 166/311 |
| 9,010,442 | B2 * | 4/2015 | Streich | E21B 34/063 166/317 |
| 2008/0245525 | A1 | 10/2008 | Rivas et al. | |
| 2011/0036585 | A1 * | 2/2011 | Sinclair | E21B 34/063 166/317 |
| 2011/0300008 | A1 | 12/2011 | Fielder et al. | |

* cited by examiner

FLUID VENT ASSEMBLY AND METHOD OF VENTING FLUID

This invention relates to a fluid vent assembly, and to a method of venting a fluid from downhole equipment used in an oil or gas well. The invention is particularly, but not exclusively, related to the provision of a gas vent assembly for venting gas from the housing that typically surrounds a downhole pump, such as an electric submersible pump, or ESP. The invention is equally suitable in relation to the venting of gas from other downhole pieces of equipment used in oil and gas wells.

ESPs are well known in the art. Typically an ESP is deployed with a housing or "shroud" that is connected to a length of production tubing, and is used to pump production fluids from within the shroud up the bore of the production tubing for recovery at the surface. ESPs are traditionally used in wells that are performing below expectation, and facilitate economic production from wells that may have a relatively low formation pressure, which may be insufficient to transmit the production fluids from the formation into the wellbore and up the production tubing by hydrostatic pressure in the formation alone. ESPs are therefore deployed in the production phase, and are typically left in place for many years during the production life of the well.

The conditions under which a typical ESP must perform are arduous, and from time to time, ESPs typically need to be recovered back to the surface for maintenance or replacement. In order to recover the ESP back to the surface for repair or replacement, the production tubing and ESP shroud to which it is connected is pulled to the surface as a whole and disassembled piece by piece as it emerges from the wellhead, or from the riser in marine wells. The lengths of production tubing are disconnected as they emerge from the wellhead until the ESP shroud is reached. During pumping operations the shroud typically accumulates pressurised fluids, and this can cause safety concerns when the shroud is being dismantled at the surface. For example, when the shroud is recovered to the surface, it is often necessary to vent any accumulated gas in the annulus between the shroud and the ESP within it before it is disassembled, and this is typically done by drilling a hole through the shroud wall using a specialised piece of equipment comprising a collar with a pre-drilled hole formed with a gland to contain the gas. This gland forms a seal around the drill as it is cutting through the wall of the shroud, to prevent the gas within the shroud annulus from escaping when the drill breaches the wall of the shroud.

According to the present invention there is provided a fluid vent assembly for a housing for a downhole tool adapted to be used in an oil or gas well, the fluid vent assembly comprising a port passing through the wall of the housing adapted to transmit fluid through the port when the port is open, a sealing device configured to seal the port, and a cutting device adapted to disrupt the sealing device and permit transmission of fluid through the port.

The invention also provides a method of venting a fluid from a housing for a downhole tool adapted to be used in an oil or gas well, the method comprising providing a port passing through the wall of the housing adapted to transmit fluid through the port when the port is open, sealing the port with a sealing device, and disrupting the sealing device with a cutting device to permit transmission of fluid through the port.

The housing typically surrounds the downhole tool, and typically defines an annulus between the housing and the downhole tool. Typically the housing is sealed around the downhole tool and is adapted to accumulate fluids from the well formation within the annulus between the housing and the downhole tool.

Typically the fluid is a gas, but can optionally include liquids, or fluids of mixed phase.

Examples of the invention provide an advantage in that they allow the operator to avoid drilling through the wall of the housing before the gas or other fluid can be vented from the shroud, which improves the safety of the disassembly operation, and reduces the risk to personnel from exposure to and possible ignition of the gases or other fluids within the annulus of the shroud, the composition of which are to a large extent unknown, and may contain hydrocarbons and/or noxious production gases such as hydrogen sulphide.

Typically the sealing device is adapted to be disrupted by the cutting device by axial movement of the cutting device. Typically the cutting device has a bore to vent gases from the housing, and the bore is typically in communication with an end of the cutting device, whereby when the end of the cutting device disrupts the sealing device, the bore is in communication with the housing, and gas can flow from the housing through the port via the bore of the cutting device.

Typically one end of the cutting device is adapted to pierce the sealing device, typically comprising an asymmetric blade positioned at one end of the cutting device, and adapted to pierce the sealing device. The asymmetric blade typically has an elliptical configuration, with a cutting surface formed in an ellipse around the end face of the cutting device. Typically the tip of the asymmetric blade has a sharp point adapted to pierce axially through the sealing device.

Typically the cutting device disrupts the sealing device to form an aperture through the sealing device in order to transmit gas through the port by axial movement of the cutting device through the sealing device. Typically the sealing device is in the form of an inverted cap, having side walls that are disposed parallel to the bore of the port, and which typically carry seals to seal the sealing device within the port. Typically at one end of the side walls, the sealing device comprises a port closure device typically in the form of a membrane or thin walled section of the sealing device extending across the axis of the port, and so that it can be pierced by the axial movement of the cutting device. Typically the closure device is provided at the lower end of the inverted cap arrangement of the sealing device, below the seals provided in the side walls, and typically the upper end of the inverted cap arrangement of the sealing device has an open end adapted to receive a stem of the cutting device, on which the asymmetric blade is provided, typically at the end of the stem, for example, at the inner end of the stem.

Typically the sealing device is held in place by a retainer, which can optionally be fixed to the wall of the port, for example by screw threads, or by fixings passing through the retainer, and into the side wall of the port. Optionally, the retainer can be provided separately from the sealing device, but this is not essential, and optionally the sealing device and retainer cap can be formed as a single member, having seals and fixing formations (screw threads, screws, etc) to retain it in place within the port in a single fixed axial location.

The sealing device typically has a pressure rating within the bore sufficient to contain the pressure of any fluids within the bore. Typically the pressure rating of the sealing device is significantly higher than the likely pressure of the fluids within the bore.

Typically the bore of the port is stepped, optionally having an internal shoulder on which the sealing device can engage, typically limiting the axial movement of the sealing device within the bore of the port, and typically denying passage of the sealing device past the shoulder. Optionally the sealing device can seal against the shoulder, typically using a metal to metal seal.

Typically the retainer cap holds the sealing device in compression against the shoulder, and typically the area of the bore of the port above the shoulder can be arranged to provide a sealing surface against which the seals on the sealing device can be compressed, thereby denying fluid passage past the sealing device when the closure device is intact.

Typically the cutting device is advanced axially through the sealing device to disrupt (e.g. pierce) the closure device by the action of a screw thread, typically acting on a nut that applies axial force to the cutting device in order to drive the blade axially through the closure device. Typically the screw thread arrangements are provided on e.g. a jacking nut to drive the axial movement of the cutting device through the closure device without requiring rotational movement of the cutting device, permitting the cutting device to be driven axially through the sealing device without relative rotation between the two.

Typically the cutting device is urged axially within the bore by a stand pipe having seals and a central bore. The seals on the stand pipe typically prevent fluid passage past the stand pipe within the bore of the port, and typically divert fluids (i.e. gases and liquids) through the bore of the stand pipe, which can typically be connected via suitable conduits, e.g. hoses or the like, to a safe exhaust location, for example at a flare, or at an overboard location on a rig, so that pressurised gases venting from the housing can be safely vented without risk to personnel working on the shroud at the rig floor.

Typically the stand pipe is urged by a jacking nut that is applied on its outer surface, urging its inner surface against the cutting device, to urge the cutting device to move axially through the sealing device and disrupt the closure device thereon to open the port.

Typically the asymmetric blade on the cutting device cuts a coupon from the closure device on the sealing device. Typically the elliptical configuration of the asymmetric blade on the cutting device means that the cutting surface of the blade is arranged at an angle relative to the axis of the bore of the vent, so as to facilitate a gradual and progressive disruption of the closure device in a controlled manner with a controlled amount of force applied by the cutting device (i.e. via the jacking nut). Typically the cutting surface of the blade has a heel portion spaced furthest away from the tip of the blade, and typically the heel of the blade is arranged to avoid cutting through the closure device, so that the coupon cut from the closure device remains attached to the closure device when the closure device is ruptured to open the seal. This can be achieved by forming the cutting surface on only a part of the ellipse, so that the heel does not cut the closure device when it engages it, and/or limiting the axial travel of the cutting device, so that the heel of the cutting surface is prevented from engaging the closure device.

Typically a check valve is provided in the port, typically at an inner end of the port, to permit passage of gases within the housing into a vent chamber within the port. Typically the sealing device is provided in the vent chamber.

Typically the downhole tool comprises an ESP, and the housing comprises the shroud of the ESP. Other types of pump, and other types of downhole equipment other than pumps, are suitable for use with examples of the present invention.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention.

Various examples and aspects of the invention will now be described in detail with reference to the accompanying figures. Still other aspects, features, and advantages of the present invention are readily apparent from the entire description thereof, including the figures, which illustrates a number of exemplary examples and aspects and implementations. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having" "containing" or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa. References to positional descriptions such as upper and lower and directions such as "up", "down" etc in relation to the well are to be interpreted by a skilled reader in the context of the examples described and are not to be interpreted as limiting the invention to the literal interpretation of the term, but instead should be as understood by the skilled addressee, particularly noting that "up" with reference to a well refers to a direction towards the surface, and "down" refers to a direction deeper into the well, and includes the typical situation where a rig is above a wellhead, and the well extends down from the wellhead into the formation, but also horizontal wells where the formation may not necessarily be below the wellhead.

Figure 1:
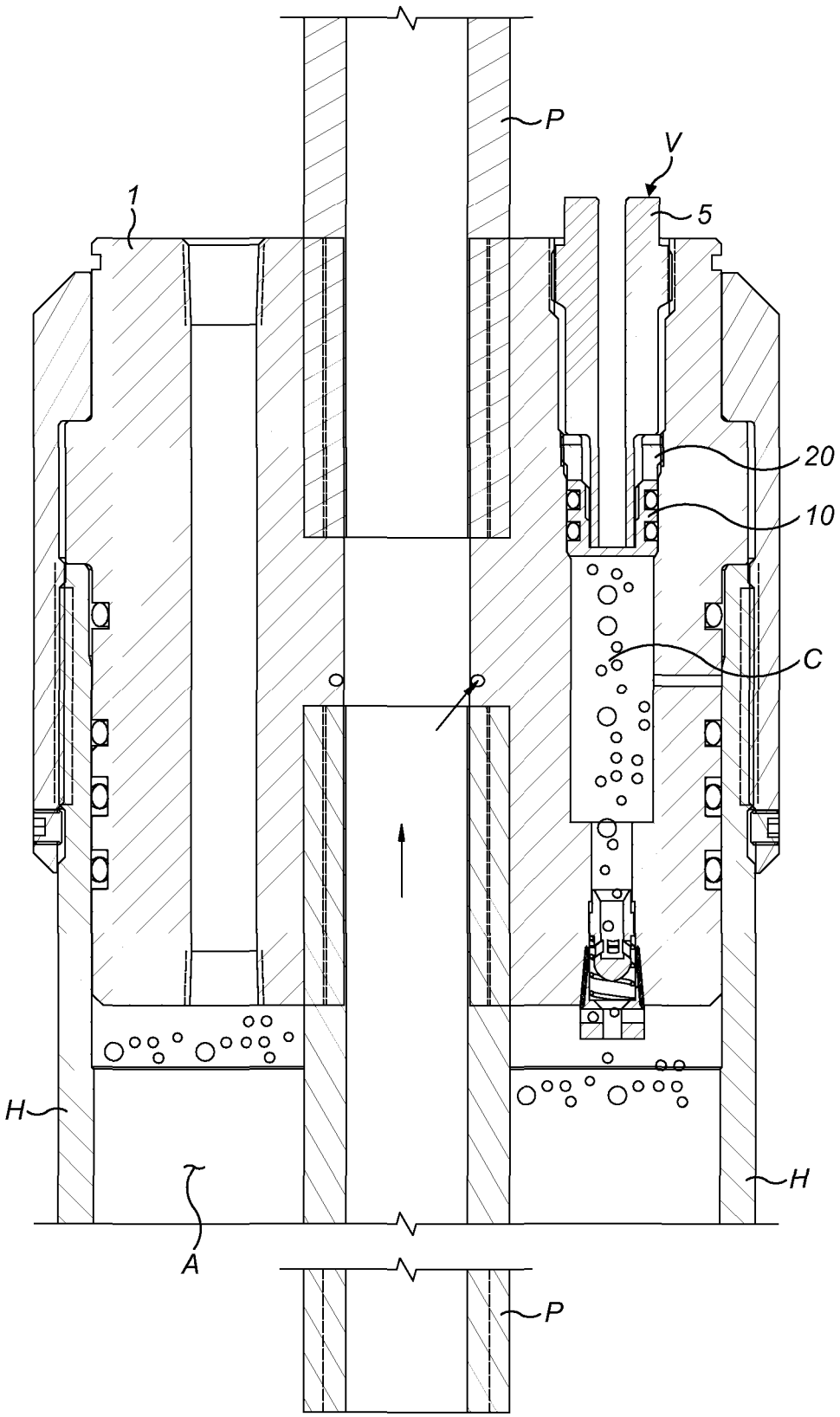
FIG. 1 shows a side sectional view through a housing for a downhole tool incorporating a gas vent assembly.

Referring now to the drawings, FIG. 1 shows a housing H for a downhole tool such as an electric submersible pump (ESP), which is not shown. The housing H is typically in the form of a shroud for the ESP which is typically deployed within the housing, so that the housing surrounds the outer surface of the ESP, and forms an annulus between the inner surface of the housing H and the outer surface of the ESP. Typically the housing is sealed around the ESP. The housing H has an end plate 1 with at least one bore for receiving and engaging with a length of production tubing P located above the housing H. The ESP is typically deployed below the end plate 1, and is typically connected in line with the production tubing P so as to collect fluids in the annulus into an inlet opening into the annulus, and pump them from the annulus through the production tubing P for recovery at the surface. Typically it is necessary to provide various penetrations through the end plate 1 of the housing H, for example to provide power and control cables to the ESP located below the end plate 1, in addition to the bore communicating with the production tubing P. The end plate bore of the production tubing P typically has box and pin connections etc allowing connection to the end plate 1 to form a conduit for produced fluids to be pumped from the ESP hanging from the production tubing P below the end plate 1, through the bore in the end plate 1, and into the production tubing P above, for recovery to the surface.

In typical designs of housing H, there is an annulus A formed between the string of production tubing P below the end plate 1 (which incorporates the ESP) and the housing H. In the operation of many downhole components, but particularly with ESPs, various fluids from the production zone commonly accumulate in the annulus A. Typically, the fluids accumulating in the annulus A include liquid and gas phase fluids from the formation. Typically not all of the fluids in the annulus A can pass through the inlet of the ESP and into the bore of the production tubing P for recovery to the surface. Accumulation of gas within the upper portions of the annulus A can be problematic when the housing H is returned to the surface for maintenance or replacement, and so in order to vent the gases safely from the annulus A, the housing H is provided with a gas vent V.

The gas vent assembly V is typically provided in the end plate 1, extending parallel to the axis of the end plate bore connecting with the production tubing P. The gas vent assembly V comprises a stepped bore drilled from the outer surface of the end plate 1, through to the inner surface of the end plate 1. At the inner surface, the bore of the gas vent is relatively narrow and typically houses a check valve admitting fluids (i.e. gas or liquid) from the annulus A into the bore of the gas vent, but restricting fluids passing in the other direction. The central section of the bore of the gas vent comprises a vent chamber C allowing for the collection of gas and other fluids that pass through the check valve at the lower end. At the upper end of the gas vent bore, above the chamber C, the valve assembly V has a sealing device in the form of a burst cartridge 10 in the general form of an inverted cap, having a planar closure device traversing and occluding the bore of the gas vent and containing any fluids within the chamber C. The side walls of the burst cartridge 10 extending above the planar closure device are typically provided with o-ring seals 11 or similar, adapted to be compressed radially between the parallel sides of the bore and the outer surface of the side walls of the burst cartridge 10, which are optionally provided with grooves to contain the seals. Typically the pressure rating of the burst cartridge 10 sealed within the bore is significantly higher than the pressures of the gas normally encountered in the bore. A typical pressure rating of the burst cartridge in one example could be 5,000-10,000 psi.

The burst cartridge 10 is open at its upper end to form the general inverted cap shape, and is provided with a retainer 20 in the form of an annular collar having a screw thread on its outer surface adapted to cooperate with a screw thread formed on the inner surface of the bore. Interaction of the external screw thread on the retainer 20 with the internal screw thread on the inner surface of the bore drives the burst cartridge 10 axially down the bore to seat on a shoulder (seen in FIG. 5) extending into the chamber.

Figure 2:
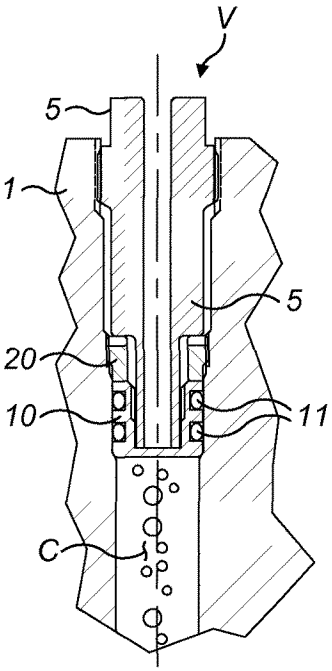
FIG. 2 shows an enlarged view of a sealing device used in the FIG. 1 arrangement.

The gas vent assembly V is provided with a running cap 5 (shown in FIGS. 1 and 2) which is used to close off the bore when the gas vent assembly V is inoperative, for example, when the downhole device is in use and does not require maintenance or replacement. The running cap 5 has a tubular body and a lower stem. The tubular body has, at its upper end, an external screw thread adapted to cooperate with an internal screw thread at the outer end of the bore, allowing the running cap 5 to be screwed down into the bore by the action of the screw threads. The stem on the lower end of the running cap 5 is received within the inverted cap arrangement of the burst cartridge 10, as shown in FIGS. 1 and 2. In the FIGS. 1 and 2 arrangements, the burst cartridge is intact, because the stem of the running cap does not penetrate it, and it is therefore effective to occlude the bore, and prevent, or restrict, the release of gas from the chamber C. The running cap 5 keeps retainer cap 20 and burst cartridge 10 in place, and restricts the access to the outer end of the bore, substantially preventing the entry of debris etc. Typically the running cap can have a cover or a closed outer surface to prevent the entry of debris into the bore and onto the burst cartridge 10.

When the housing H is to be returned to the surface for repair or replacement of the ESP or other tool, the production tubing P and housing H are typically pulled back to the surface for remedial operations to take place. Once at the surface, the running cap 5 is typically removed while the retainer 20 retains the burst cartridge in compression against the lower shoulder, so as to maintain the seal provided by the closure device at the lower end of the burst cartridge 10. When gas is to be vented from the chamber C, the running cap 5 is removed, and a cutting device 50 is inserted into the outer end of the bore. The cutting device 50 typically has an inverted top hat structure, with an upper flange and a lower stem. The inverted top hat structure of the cutting device 50 typically has an axial throughbore, allowing communication of the gas through the central bore of the cutting device when the seal has been broken. The lower end of the cutting device has a piercing member in the form of an asymmetric blade 51. The asymmetric blade 51 is formed in an elliptical configuration with a sharp tip. The ellipse formed by the asymmetric blade 51 can be arranged at a fixed angle, or alternatively, the angle of the ellipse can change along the length of the blade 51. In typical examples of the invention, the asymmetric blade has a sharpened tip at the lowermost end of the blade 51, which is typically adapted to engage with the closure device provided by the planar face of the burst cartridge 10, to pierce a hole in the closure device and thereby permit the venting of gas from the chamber C. The elliptical arrangement of the asymmetric blade 51 means that continuous downward axial movement of the cutting device 50 progressively cuts through different areas of the planar closure device extending across the bore.

Figure 3:
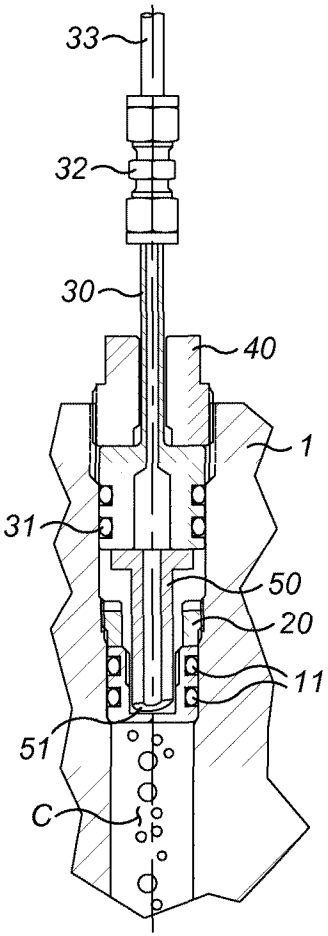
FIG. 3 shows a side view of the FIG. 2 seal arrangement, with a stand pipe and jacking nut used to connect the port to a control line.

Axial translation of the cutting device 50 is typically driven by a separate item, typically via a stand pipe 30 provided immediately above the cutting device 50, and having a lower surface that bears on the inverted top hat structure of the cutting device 50. The outer surface of the stand pipe 30 has a sealing arrangement, for example in the form of O ring seals 31, which typically provide a fluid tight seal between the stand pipe 30 and the inner walls of the bore above the burst cartridge 10. The stand pipe 30 is typically moved down axially within the bore without rotation, by means of a separate jacking nut 40 provided outside the stand pipe 30, which has an arrangement of spanner flats at its outer surface, or a similar arrangement for allowing the transmission of torque, and an external screw thread on its lower surface, adapted to engage with an internal screw thread at the mouth of the bore on the outer surface of the end plate 1. Rotation of the jacking nut 40 under the action of a spanner or the like, drives the jacking nut 40 axially downwards pushing the stand pipe 30 down through the bore without rotation, and thus axially driving the cutting device 50 from the FIG. 3 position, in which the asymmetric blade 51 has not pierced through the planar closure device provided by the burst cartridge, to the FIG. 4 position, where the cutting device 50 has been pushed axially part of the way through the planar closure device via the jacking nut 40 and the stand pipe 30.

The stand pipe 30 typically has a central bore, provided with a stem extending upwardly through the jacking nut 40, and terminating with a tube fitting 32 for connection to a hose 33. Once the cutting device 50 has cut through the burst cartridge 10 as shown in FIG. 4, gases and other fluids trapped in the chamber C can vent through the bore of the cutting device 50, through the bore of the stand pipe 30 and its stem, through the tube fitting 32 and into the hose 33, which can be routed to a safe exhaust location, such as a flare, or an outboard vent, allowing the gases trapped in the chamber C to be vented safely without excessive risk to rig personnel.

Figure 5:
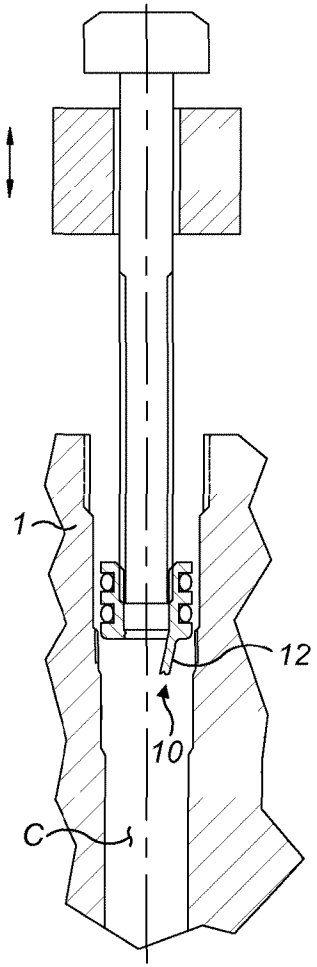
FIG. 5 shows the retrieval of the sealing device by a removal tool.

Once the pressure has equalised across the burst cartridge 10, it can be removed using a removal tool as shown in FIG. 5.

Figure 4:
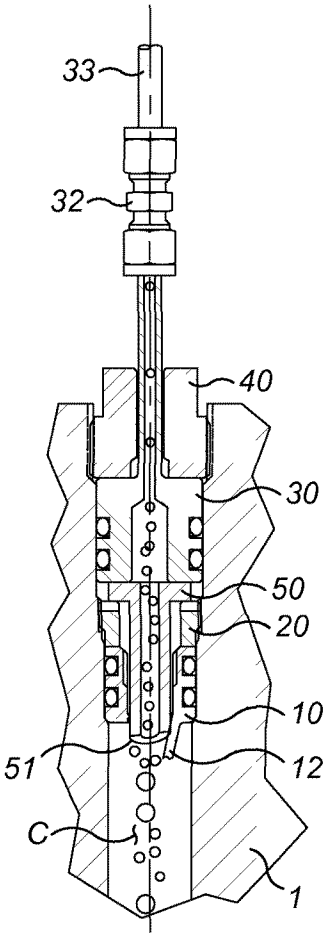
FIG. 4 shows a view similar to FIG. 3, showing the cutting device of the assembly penetrating the sealing device.

Typically the cutting device 50 is adapted to cut only a portion of the planar closure device at the lower face of the burst cartridge 10, and typically leaves the cut portion attached as a coupon 12, as shown in FIG. 4 and FIG. 5.

Figure 6:
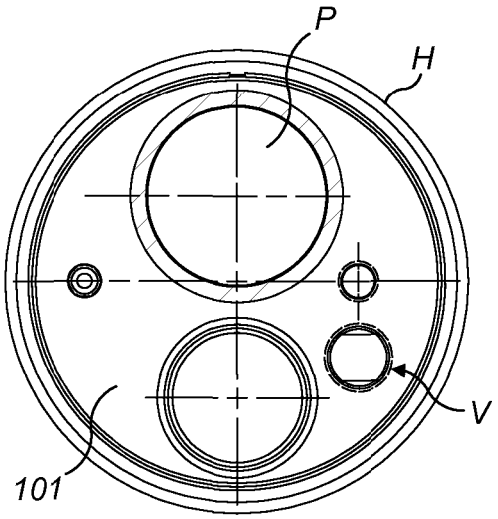
FIG. 6 shows a plan view of a second housing for a downhole tool, incorporating a gas vent assembly.
Figure 7:
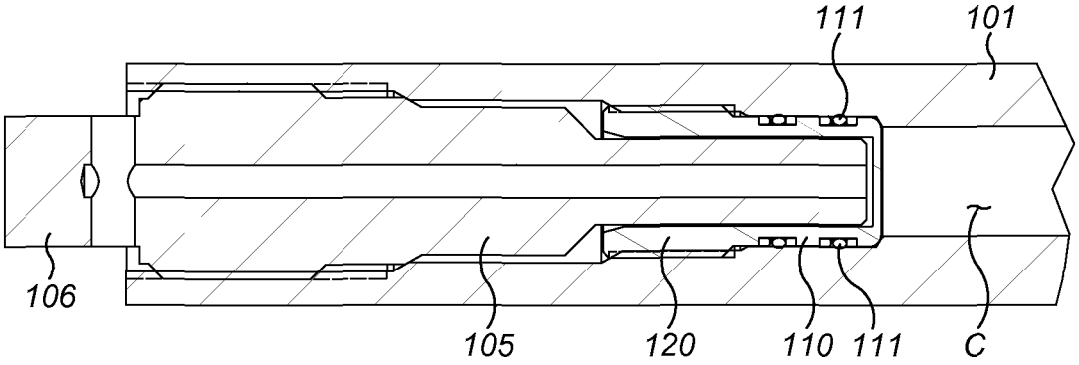
FIGS. 7 to 11 show side sectional views of the gas vent assembly of FIG. 6 in sequential stages of activation.

Referring now to FIGS. 6 to 11, a further gas vent assembly is provided in a housing H surrounding an ESP as shown in FIG. 6. In the FIG. 6 assembly, many of the features are similar to those described above for the FIG. 1 assembly, and hence will not be described in detail hereafter, and will be referenced with the same reference number as used in relation to the FIG. 1 assembly, but increased by 100. The reader is referred to these above-described features for additional details of the structure and function of the shared features of the FIG. 6 assembly. The end plate 101 shows the production bore P and the gas vent V of the FIG. 6 assembly. Numerous other penetrations are typically provided in the end plate 101. Referring to FIG. 7, the running cap 105 is screwed into the upper end of the bore from the outer surface of the end plate 101, to extend its stem through the burst cartridge 110. In this example, the burst cartridge 110 and the retainer cap 120 are formed as a single unit, typically of metal, and the retainer cap 120 is provided with threads on its outer surface in order to engage inwardly facing screw threads on the inner sides of the bore. The lower shoulder of the burst cartridge 110 engages with the upwardly facing shoulder on the inner surface of the bore, in order to fix the burst cartridge 110 in a fixed axial location within the bore, typically forming a metal to metal seal.

Figure 8:
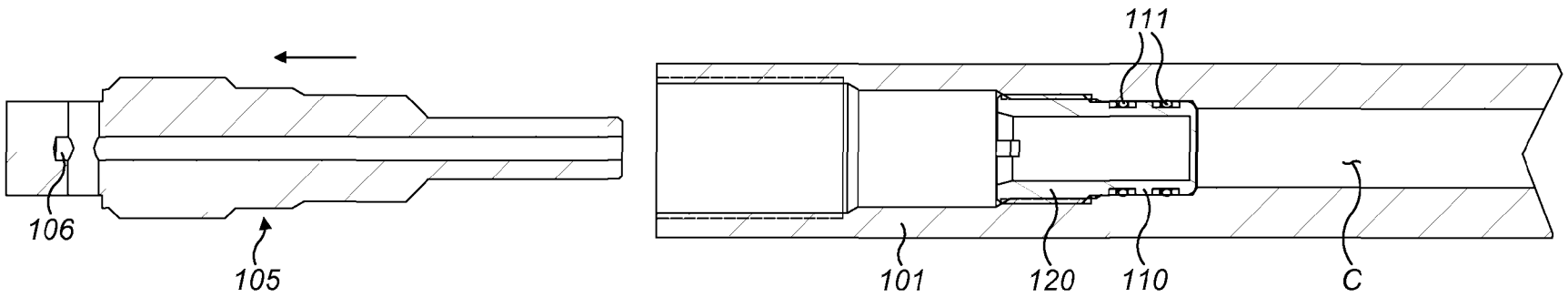
Figure 9:
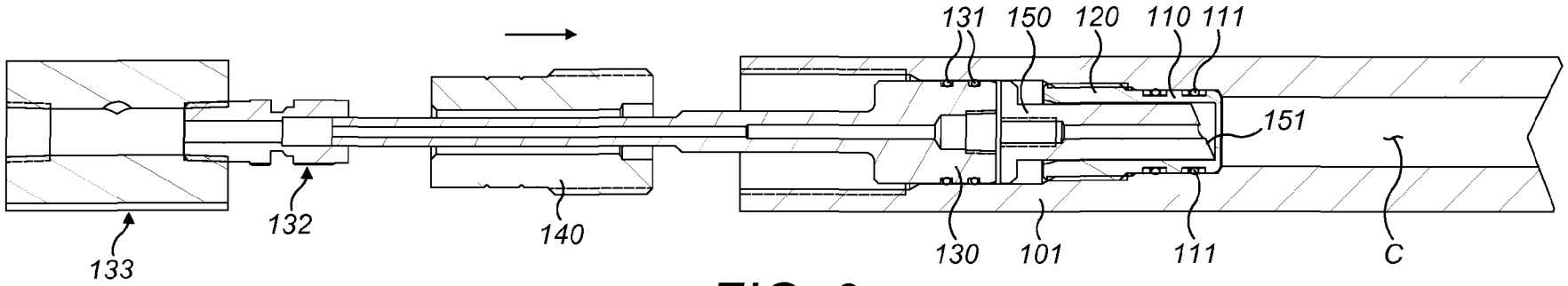
Figure 10:
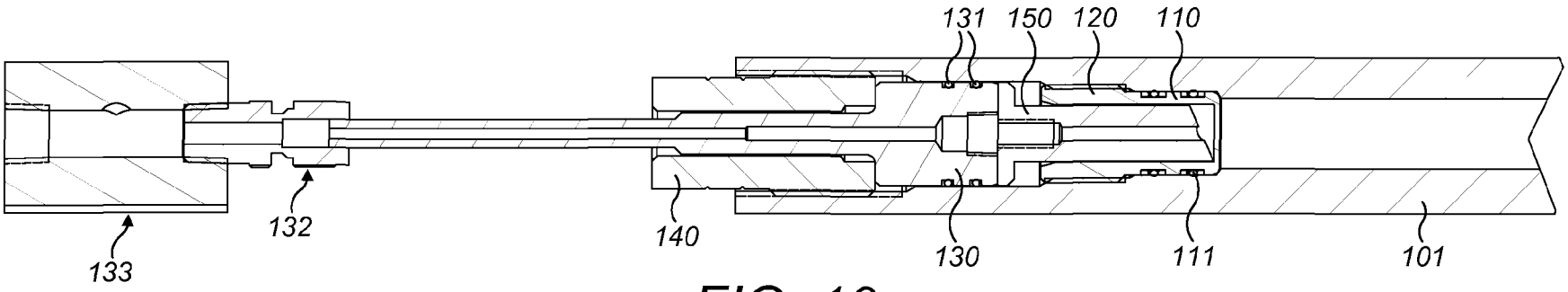
Figure 11:
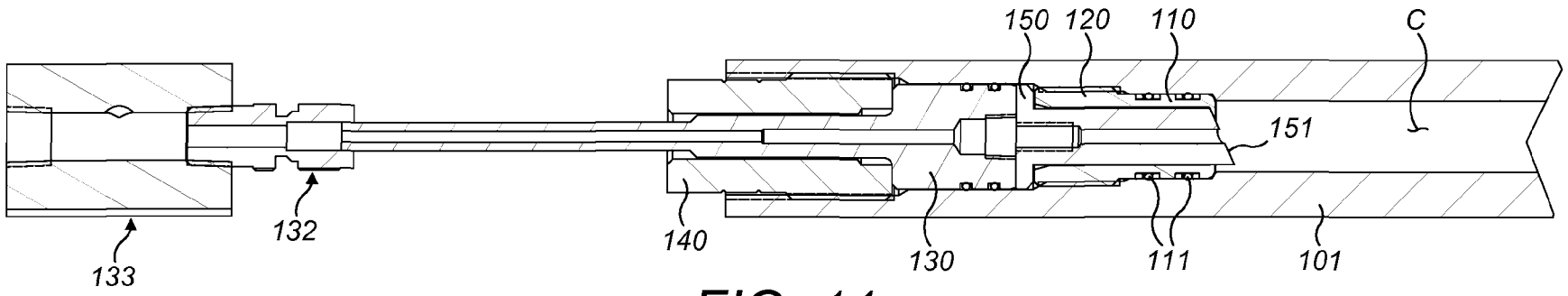

The central bore through the running cap 105 is typically closed at the upper end by an end plate 106. FIG. 8 shows the running cap 105 being withdrawn axially from the bore, while the burst cartridge 110 is retained in place butted against the upwardly facing shoulder in the inner wall of the bore by the screw threads on the outer surface of the retainer cap 120. The seals 111 on the outer surface of the burst cartridge 110 typically restrict or prevent fluid transmission past the burst cartridge 110, and retain the gases trapped in the chamber C. When the running cap 105 has been removed, the cutting device 150 is inserted into the bore from the outer surface of the end plate 101, followed by the stand pipe 130, and the jacking nut 140. The jacking nut 140 has a central bore adapted to receive the upwardly extending stem of the stand pipe 130, which, at its upper end, engages with a tube fitting 132 for connection to a hose 133 and safe disposal as previously described. The jacking nut 140 is then screwed into the inwardly facing threads on the inner surface of the bore at the upper end, as shown in FIG. 10, and is screwed in to drive the asymmetric blade 151 at least partially through the lower face of the burst cartridge 110 as shown in FIG. 11.

Piercing of the closure device formed by the bottom of the burst cartridge opens the seal and permits the venting of the gas contained by the sealing device in the chamber C, through the bore of the cutting device 150, up the stem of the stand pipe 130 and into the hose 133 for safe disposal at a vent point or flare etc. As before, the asymmetric blade 151 typically does not cut completely through the planar plate at the bottom of the burst cartridge, and retains the coupon on the burst cartridge, although in modifications of this design the cut portion of the closure member can be entirely removed from the burst cap.

Typically the burst cartridge 110 and optionally the retainer cap 120 if it is a separate member, are formed from metal, and typically the lower planar part of the burst cartridge extending across the axis of the bore to occlude the bore is optionally formed from a thin metal adapted to be pierced by the asymmetric blade 151. A weakened area can be formed in the burst cartridge, adapted to fail when engaged by the blade, in a predictable manner, and with a predictable cutting path.

Figure 12:
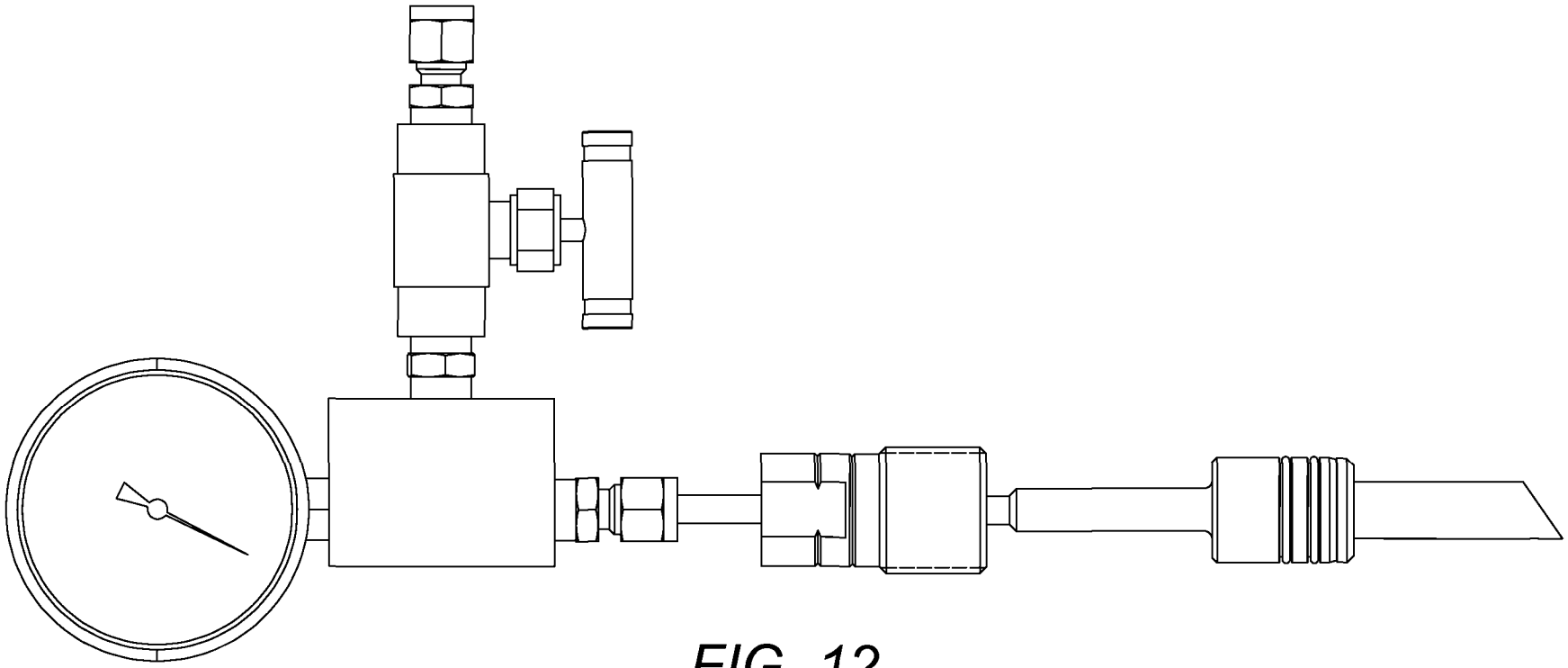
FIG. 12 shows a tool kit for use with the gas vent assembly at the surface.

As shown in FIG. 12, once the cutter device has been advanced through the burst cartridge, it can be recovered from the bore by means of a removal tool, typically having a threaded shaft adapted to engage within an inwardly threaded part at the upper portion of the bore extending axially through the cutter device 150. Typically the hose 133 can have pressure gauges, flow meters and the like to determine and optionally to measure and/or record the amount and/or pressure of the gas flowing from the chamber C.

Modifications and improvements can be incorporated without departing from the scope of the invention.

The invention claimed is:

1. A fluid vent system for a downhole tool, the fluid vent system comprising:

a port passing through a wall of a housing for the downhole tool and adapted to transmit fluid through the port when the port is open;

a sealing device configured to seal the port; and a cutting device having an end adapted to pierce the sealing device and permit transmission of fluid through the port;

wherein the downhole tool comprises an Electric Submersible Pump (ESP), and the housing comprises a shroud of the ESP.

2. The fluid vent system of claim 1, wherein the housing surrounds the downhole tool and defines an annulus between the housing and the downhole tool, and wherein the housing is sealed around the downhole tool and is adapted to accumulate fluids within the annulus prior to transmission of the fluids through the fluid vent system.

3. The fluid vent system of claim 1, wherein the fluid transmitted through the fluid vent system comprises a gas.

4. The fluid vent system of claim 1, wherein the sealing device is pierced by axial movement of the cutting device.

5. The fluid vent system of claim 1, wherein the cutting device comprises a bore in communication with an opening at an end of the cutting device, which opening penetrates the sealing device when the end of the cutting device pierces the sealing device, and wherein, when the opening penetrates the sealing device, the bore is in fluid communication with the housing and fluids can flow from the housing through the port via the bore of the cutting device.

6. The fluid vent system of claim 1, wherein the end of the cutting device has a pointed tip.

7. The fluid vent system of claim 6, wherein the end of the cutting device comprises a blade positioned at the end of the cutting device and is asymmetric about at least one plane.

8. The fluid vent system of claim 7, wherein the blade has an elliptical configuration with a cutting surface formed in an ellipse around an end face of the cutting device.

9. The fluid vent system of claim 8, wherein the elliptical cutting surface surrounds an elliptical opening in the cutting device.

10. The fluid vent system of claim 1, wherein the port has a bore with an axis, wherein the sealing device comprises an inverted cap having side walls that are disposed parallel to the axis of the bore, and wherein the housing includes seals to seal the sealing device within the port.

11. The fluid vent system of claim 10, wherein the sealing device comprises a port closure device having a wall extending across the axis of the port at a lower end of the side walls and positioned below at least one annular seal that extends into the bore from the side walls, and wherein an upper end of the inverted cap of the sealing device has an opening adapted to receive the cutting device.

12. The fluid vent system of claim 1, including a sealing device retainer holding the sealing device in a fixed axial location in the port.

13. The fluid vent system of claim 1, wherein the port comprises a stepped bore having an internal shoulder on which the sealing device can engage to limit axial movement of the sealing device within the stepped bore and deny passage of the sealing device past the internal shoulder.

14. The fluid vent system of claim 13, wherein the sealing device includes a retainer cap holding the sealing device in compression against the internal shoulder.

15. The fluid vent system of claim 14, wherein the stepped bore of the port above the internal shoulder provides a sealing surface against which seals on the sealing device are compressed when the sealing device is in the port, thereby denying fluid passage past the sealing device.

16. The fluid vent system of claim 1, comprising an axial driver mechanism configured to drive axial movement of the cutting device through the sealing device.

17. The fluid vent system of claim 16, wherein the axial driver mechanism comprises a screw thread device arranged to drive a blade of the cutting device axially through the sealing device without rotating the cutting device.

18. The fluid vent system of claim 1, wherein a cutting surface of the cutting device is shaped to cut a partial coupon from the sealing device and to leave the partial coupon attached to the sealing device when the sealing device is ruptured to open the port.

19. The fluid vent system of claim 1, comprising a check valve disposed within the port.

20. The fluid vent system of claim 1, wherein the sealing device comprises a weakened area, and wherein the sealing device is adapted to fail along the weakened area when pierced by the end of the cutting device.

21. A method of venting a fluid from a housing for a downhole tool for an oil or gas well, the method comprising providing a port passing through a wall of the housing adapted to transmit fluid through the port when the port is open, sealing the port with a sealing device, and piercing the sealing device with one end of a cutting device to permit transmission of fluid through the port; wherein the cutting device has a bore to vent fluids from the housing, and wherein the bore is in communication with an opening at an end of the cutting device which in use penetrates the sealing device when the end of the cutting device pierces the sealing device, and wherein the method includes flowing fluids from the housing through the opening at the end of the cutting device and through the port via the bore of the cutting device.

22. The method of claim 21, comprising driving a piercing portion of the cutting device axially through the sealing device without rotating the piercing portion of the cutting device.

23. The method of claim 21, comprising exhausting fluids passing through the vent to a safe exhaust location.

24. The method of claim 21, comprising cutting a partial coupon from the sealing device and leaving the partial coupon attached to the sealing device when the sealing device is ruptured to open the port.

25. The method of claim 21, comprising cutting the sealing device by axially moving an asymmetric blade on the cutting device through the sealing device, and wherein the asymmetric blade cuts different radial parts of the sealing device as the asymmetric blade moves axially through the sealing device.

26. The method of claim 21, wherein the sealing device comprises a weakened area, and wherein the cutting device engages the weakened area during the piercing and the weakened area fails along the weakened area.

27. A fluid vent system for a housing for a downhole tool adapted to be used in an oil or gas well, the fluid vent system comprising a port adapted to transmit fluid through the port when the port is open, a sealing device configured to seal the port, and a cutting device having an end adapted to pierce the sealing device to permit transmission of fluid through the port; wherein the cutting device has a bore to vent fluids from the housing, and wherein the bore is in communication with an opening at an end of the cutting device which in use penetrates the sealing device when the end of the cutting device pierces the sealing device, whereby when the opening at the end of the cutting device penetrates the sealing device, fluids can flow from the housing through the port via the bore of the cutting device.

28. The fluid vent system of claim 27, wherein the cutting device is disposed in line with the sealing device, and wherein the end of the sealing device is pierced by axial movement of the cutting device.

29. The fluid vent system of claim 27, wherein the end of the cutting device has a pointed tip adapted to pierce the sealing device.

30. The fluid vent system of claim 29, wherein the pointed tip adapted to pierce the sealing device comprises a blade positioned at the end of the cutting device, and wherein the blade is asymmetric about at least one plane.

31. The fluid vent system of claim 30, wherein the asymmetric blade has an elliptical configuration with a cutting surface formed in an ellipse around an end face of the cutting device.

32. The fluid vent system of claim 31, wherein the elliptical cutting surface surrounds an elliptical opening in the cutting device.

33. The fluid vent system of claim 27, wherein the port has a bore with an axis, and wherein the sealing device is an inverted cap having side walls that are disposed parallel to the axis of the bore, and wherein the sealing device is sealed within the port.

34. The fluid vent system of claim 33, wherein the sealing device comprises a port closure device comprising a wall extending across the axis of the port at a lower end of the side walls and positioned below at least one annular seal extending into the bore from the side walls, and wherein an upper end of the inverted cap of the sealing device has an opening adapted to receive the cutting device.

35. The fluid vent system of claim 27, comprising a sealing device retainer holding the sealing device in a fixed axial location in the port.

36. The fluid vent system of claim 27, wherein the port comprises a stepped bore having an internal shoulder on which the sealing device can engage to limit axial movement of the sealing device within the stepped bore and deny passage of the sealing device past the internal shoulder.

37. The fluid vent system of claim 36, wherein the sealing device includes a retainer cap holding the sealing device in compression against the internal shoulder.

38. The fluid vent system of claim 37, wherein the stepped bore of the port above the internal shoulder provides a sealing surface against which seals on the sealing device are compressed when the sealing device is in the port, thereby denying fluid passage past the sealing device.

39. The fluid vent system of claim 27, including an axial driver mechanism configured to drive axial movement of the cutting device through the sealing device.

40. The fluid vent system of claim 39, wherein the axial driver mechanism comprises a screw thread device arranged to drive a blade of the cutting device axially through the sealing device without rotating the cutting device.

41. The fluid vent system of claim 27, wherein a cutting surface of the cutting device is shaped to cut a partial coupon from the sealing device and to leave the partial coupon attached to the sealing device when the sealing device is ruptured to open the port.

42. The fluid vent system of claim 27, including a check valve.

43. The fluid vent system of claim 27, wherein the sealing device comprises a weakened area, and wherein the sealing device is adapted to fail along the weakened area when pierced by the end of the cutting device.

44. An Electric Submersible Pump (ESP) comprising the fluid vent system of claim 27.

45. A fluid vent assembly as claimed in claim 27, wherein the housing surrounds the downhole tool, and defines an annulus between the housing and the downhole tool, wherein the housing is sealed around the downhole tool and is adapted to accumulate fluids within the annulus between the housing and the downhole tool prior to transmission through the fluid vent assembly.

* * * * *